US006848920B2

(12) United States Patent
Fox

(10) Patent No.: US 6,848,920 B2
(45) Date of Patent: Feb. 1, 2005

(54) METHOD AND ASSEMBLY FOR CONNECTING A COAXIAL CABLE TO AN EXTERNALLY THREADED CONNECTING PART

(75) Inventor: Michael T. Fox, Syracuse, NY (US)

(73) Assignee: John Mezzalinqua Associates, Inc., East Syracuse, NY (US)

( * ) Notice: Subject to any disclaimer, the term of this patent is extended or adjusted under 35 U.S.C. 154(b) by 0 days.

(21) Appl. No.: 10/378,219

(22) Filed: Mar. 3, 2003

(65) Prior Publication Data

US 2004/0175990 A1 Sep. 9, 2004

(51) Int. Cl.[7] ..... H01R 13/44
(52) U.S. Cl. ..... 439/133; 81/461
(58) Field of Search ..... 439/133, 307, 439/308, 578; 81/58.1, 461, 176.15, 442

(56) References Cited

U.S. PATENT DOCUMENTS

| | | | | |
|---|---|---|---|---|
| 3,519,979 A | | 7/1970 | Bodenstein | 439/133 |
| 3,845,454 A | | 10/1974 | Hayward et al. | 439/307 |
| 3,861,770 A | | 1/1975 | Horak | 439/133 |
| 3,953,097 A | | 4/1976 | Graham | 439/307 |
| 4,053,195 A | | 10/1977 | Laverick et al. | 439/308 |
| 4,168,921 A | | 9/1979 | Blanchard | 439/19 |
| 4,393,583 A | * | 7/1983 | Zwald | 29/857 |
| 4,469,386 A | | 9/1984 | Ackerman | 439/133 |
| 4,759,122 A | * | 7/1988 | Weintraub | 29/750 |
| 5,011,422 A | | 4/1991 | Yeh | 439/307 |
| 5,273,444 A | | 12/1993 | Down et al. | 439/133 |
| 5,440,282 A | | 8/1995 | Devendorf et al. | 439/578 |
| 5,564,938 A | | 10/1996 | Shenkal et al. | 439/301 |
| H001689 H | * | 11/1997 | Foucher | 81/124.3 |
| 5,723,818 A | | 3/1998 | Yeh | 174/74 R |
| 5,749,272 A | * | 5/1998 | Phan | 81/62 |
| 6,153,830 A | | 11/2000 | Montena | 439/578 |

* cited by examiner

*Primary Examiner*—Tulsidas C. Patel
(74) *Attorney, Agent, or Firm*—Wood, Phillips, Katz, Clark & Mortimer

(57) ABSTRACT

An assembly for connecting a coaxial cable to an externally threaded connecting part. The connecting assembly has a tubular fitting with a central axis and axially spaced first and second ends. The tubular fitting includes a rotatable nut at the first end to threadably engage an externally threaded connecting part. The second end is adapted to receive a coaxial cable. The rotatable nut has a contoured surface portion configured to be operatively engaged by a complementary turning tool having a first configuration that is directed radially into turning engagement with the rotatable nut and useable to turn the rotatable nut around the central axis. The shield assembly extends around the rotatable nut and blocks radial access to the contoured outer surface by a turning tool having the first configuration. The shield assembly does not extend substantially beyond the rotatable nut towards the second end of the tubular fitting. The shield assembly is configured so that a second tool having a second configuration can be directed axially into turning engagement with the rotatable nut to facilitate turning of the rotatable nut around the central axis.

34 Claims, 5 Drawing Sheets

METHOD AND ASSEMBLY FOR CONNECTING A COAXIAL CABLE TO AN EXTERNALLY THREADED CONNECTING PART

BACKGROUND OF THE INVENTION

1. Field of the Invention

This invention relates to connectors for coaxial cable and, more particularly, to a method and assembly for connecting a coaxial cable to an externally threaded connecting part so as to avoid unauthorized separation of the coaxial cable from the externally threaded connecting part.

2. Background Art

Coaxial cable is used in cable television systems (CATV), subscription television systems (STV) and master antenna television systems (MATV). It is common to connect coaxial cable in these systems using releasable connectors at a splice or drop location. To avoid unauthorized separation of a coaxial cable end connector, as might permit an unauthorized diversion of a cable signal, various tamper-proofing systems have been devised in the industry. As one example, U.S. Pat. No. 5,723,818 (Yeh) discloses a stepped diameter, cylindrical body which fully covers an "F" connector, including the region of the connector which is crimped to the coaxial cable end. A clamping element blocks withdrawal of the cable end, with the connector thereon, from the body. The system is set up with the end connector pre-attached to the coaxial cable. A special tool is directed through the clamping element to engage a polygonally-shaped outer surface of a rotatable nut on the connector to effect rotation thereof.

Each of U.S. Pat. No. 4,053,195, to Laverick et al (Laverick), and U.S. Pat. No. 4,168,921 (Blanchard) discloses a cup-shaped sleeve which covers a rotatable nut on a connector so that radial access thereto through a conventional wrench is prohibited. A turning tool is directed axially through the open end of the sleeve to engage a polygonally-shaped surface of the nut. In Both Laverick and Blanchard, the end connector is crimped to the cable end before installation of the sleeve.

In Laverick, Blanchard, and Yeh, a special tool having cantilevered legs is required for operation. Due to the axial extent of the protective structure in each, these legs must be relatively long and are thus prone to deformation as a torquing force is applied to the tool. This may prevent removal, through the tool, of a connection that is locked in place due to corrosion or held firmly by reason of the nut thereon being turned tightly into place in the initial installation.

U.S. Pat. No. 4,469,386 (Ackerman) discloses a coaxial plug which is held in place by a specially designed cap that is threaded upon an externally threaded connecting part. The cap is designed to be turned by a complementary tool, which is required to be directed into a cavity occupied by the cap.

SUMMARY OF THE INVENTION

In one form, the invention is directed to an assembly for connecting a coaxial cable to an externally threaded connecting part. The connecting assembly has a tubular fitting with a central axis and axially spaced first and second ends. The tubular fitting includes a rotatable nut at the first end to threadably engage an externally threaded connecting part. The second end is adapted to receive a coaxial cable. The rotatable nut has a contoured surface portion configured to be operatively engaged by a complementary turning tool having a first configuration that is directed radially into turning engagement with the rotatable nut and useable to turn the rotatable nut around the central axis. The shield assembly extends around the rotatable nut and blocks radial access to the contoured outer surface by a turning tool having the first configuration. The shield assembly does not extend substantially beyond the rotatable nut towards the second end of the tubular fitting. The shield assembly is configured so that a second tool having a second configuration can be directed axially into turning engagement with the rotatable nut to facilitate turning of the rotatable nut around the central axis.

In one form, the shield assembly is reconfigured with the shield assembly surrounding the tubular fitting so as to fixedly maintain the shield assembly operatively connected to the tubular fitting.

In one form, the shield assembly is reconfigured by forming a portion of the shield assembly radially inwardly so as to define a first axially facing surface that abuts to an axially facing surface on the tubular fitting to thereby confine relative axial movement between the shield assembly and tubular fitting.

In one form, the shield assembly has a radially extending wall with at least one opening therethrough to receive a second tool having a second configuration, which has a portion that can be directed axially through the at least one opening to be operatively engaged with the rotatable nut to facilitate turning of the rotatable nut around the central axis.

In one form, the rotatable nut has diametrically opposite, oppositely facing, first and second flat surfaces. The at least one opening permits spaced elements on a second tool having the second configuration to be directed axially into engagement with the first and second flat surfaces.

In one form, the at least one opening consists of first and second discrete openings.

In one form, the shield assembly is rotatable guidingly relative to the tubular fitting around the central axis.

In one form, the second end of the tubular fitting defines a connecting body to receive an insulating core on a coaxial cable. The tubular fitting includes a surrounding sleeve which is radially deformable from a starting state into a holding state to capture a metallic sheath and an insulating jacket on a coaxial cable between the connecting body and surrounding sleeve. The surrounding sleeve is exposed axially from the shield assembly sufficiently to allow the surrounding sleeve to be changed from the starting state into the holding state.

The shield assembly may be in the form of an annular body with radially inwardly extending, axially spaced, first and second walls.

In one form, the rotatable nut has first and second axially oppositely facing surfaces. The first and second walls on the shield assembly define first and second surfaces facing axially towards each other. The first surface on the first wall is abuttable to the first surface on the rotatable nut to limit movement of the shield assembly in one axial direction relative to the tubular fitting. The second surface on the second wall is abuttable to the second surface on the rotatable nut to limit movement of the shield assembly axially oppositely to the one axial direction relative to the tubular fitting.

In one form, the contoured surface of the rotatable nut is defined by a plurality of flat surfaces defining a polygonal shape to be engageable by a conventional wrench.

The invention contemplates the above connecting assembly in combination with a tool having the second configuration. The tool with the second configuration has cantilevered first and second legs which are extendable through the at least one opening through the radially extending wall.

In one form, the first leg has a shoulder thereon to abut to the radially extending wall to limit axial movement of the first leg through the radially extending wall.

The invention is further directed to an assembly for connecting a coaxial cable to an externally threaded connecting part. The connecting assembly has a tubular fitting with a central axis and axially spaced first and second ends. The tubular fitting has a rotatable nut at the first end to threadably engage an externally threaded connecting part. The second end is adapted to receive a coaxial cable. The shield assembly extends fully around the rotatable nut. The second end of the tubular fitting defines a connecting body to receive an insulating core on a coaxial cable. The tubular fitting further has a surrounding sleeve which is radially deformable from a starting state into a holding state to capture a metallic sheath and an insulating jacket on a coaxial cable between the connector body and surrounding sleeve. The surrounding sleeve is exposed axially from the shield assembly sufficiently to allow the surrounding sleeve to be changed from the starting state into the holding state. A tool can be directed axially into engagement with the rotatable nut to facilitate turning of the rotatable nut. The shield assembly blocks radial access to the rotatable nut by a turning tool.

In one form, the shield assembly has a radially extending wall and the radially extending wall has at least one opening therethrough to receive a second tool having the second configuration which has a portion that can be directed axially through the at least one opening to be operatively engaged with the rotatable nut to facilitate turning of the rotatable nut around the central axis.

The rotatable nut may have diametrically opposite, oppositely facing, first and second flat surfaces to be engaged by a turning tool.

The connecting assembly may further be provided in combination with a turning tool having first and second spaced elements which are engageable, one each, with the first and second flat surfaces.

In one form, the at least one opening consists of first and second discrete openings to receive the first and second spaced elements.

In one form, the shield assembly is reconfigured with the shield assembly surrounding the tubular fitting so as to fixedly maintain the shield assembly operatively connected to the tubular fitting.

In one form, the shield assembly is reconfigured by forming a portion of the shield assembly radially inwardly so as to define a first axially facing surface that abuts to an axially facing surface on the tubular fitting to thereby confine relative axial movement between the shield assembly and tubular fitting.

In one form, the shield assembly has an annular body with radially inwardly extending, axially spaced, first and second walls.

In one form, the rotatable nut has first and second axially oppositely facing surfaces. The first and second walls on the shield assembly define first and second surfaces facing axially towards each other. The first surface on the first wall is abuttable to the first surface on the rotatable nut to limit movement of the shield assembly in one axial direction relative to the tubular fitting. The second surface on the second wall is abuttable to the second surface on the rotatable nut to limit movement of the shield assembly axially oppositely to the one axial direction relative to the tubular fitting.

In one form, the first spaced element has a shoulder thereon to abut to the shield assembly to limit axial movement of the first spaced element relative to the shield assembly.

The invention is further directed to an assembly for connecting a coaxial cable to an externally threaded connecting part. The connecting assembly has a tubular fitting with a central axis and axially spaced first and second ends. The tubular fitting has a rotatable nut at the first end to threadably engage an externally threaded connecting part. The second end is adapted to receive a coaxial cable. A shield assembly extends around the annular nut The second end of the tubular fitting defines a connecting body to receive an insulating core on a coaxial cable. The tubular fitting further has a surrounding sleeve which is radially deformable from a starting state into a holding state to capture a metallic sheath and an insulating jacket on a coaxial cable between the connecting body and surrounding sleeve. The surrounding sleeve is exposed axially from the shield assembly sufficiently to allow the surrounding sleeve to be changed from the starting state into the holding state.

In one form, the shield assembly has a first radially extending wall and a second radially extending wall. The first and second radially extending walls define axially facing first and second surfaces between which a part of the tubular fitting resides so that the shield assembly is limited in movement in axially opposite directions relative to the tubular fitting. In one form, the rotatable nut defines the part of the tubular fitting.

The invention is further directed to an assembly for connecting on coaxial cable to an externally threaded connecting part. The tubular fitting has a central axis and axially spaced first and second ends. The tubular fitting has a rotatable nut at the first end to threadably engage an externally threaded connecting part. The second end is adapted to receive a coaxial cable. Structure is provided on the tubular fitting that can be reconfigured to grippingly hold an end of a coaxial cable. A shield structure is operatively connected to the tubular fitting so as to permit access to the rotatable nut by a turning tool directed axially up to the rotatable nut. The shield structure blocks access to the rotatable nut by a turning tool directed radially toward the rotatable nut. The shield structure is configured so that the structure on the tubular fitting can be reconfigured to grippingly hold an end of a coaxial cable with the shield structure operatively connected to the tubular fitting.

The invention is further directed to a method of connecting a coaxial cable to an externally threaded connecting part through a tubular fitting having a central axis, axially spaced first and second ends, and a rotatable nut on the first end. The method includes the steps of: threadably connecting the rotatable nut to the externally threaded connecting part; attaching a shield assembly to the tubular fitting so that the shield assembly blocks radial access to the rotatable nut; directing the coaxial cable into the second end of the tubular fitting; and with the coaxial cable in the second end of the tubular fitting and the shield assembly attached to the tubular fitting, reconfiguring the tubular fitting to grippingly hold the coaxial cable and tubular fitting together.

In one form, the shield assembly is attached to the tubular fitting before the rotatable nut is threadably connected to the externally threaded connecting part.

The step of attaching a shield assembly may involve deforming a part of the shield assembly with the shield assembly surrounding the tubular fitting.

In one form, the step of threadably connecting the rotatable nut involves directing a turning tool axially relative to the tubular fitting into engagement with the rotatable nut radially between the shield assembly and rotatable nut.

The step of directing a turning tool may involve directing first and second legs on the turning tool axially relative to the tubular fitting so that the first and second legs captively engage first and second oppositely facing flat surfaces on the rotatable nut.

In one form, the step of directing a turning tool involves directing first and second legs on the turning tool through first and second discrete openings through the shield assembly.

DETAILED DESCRIPTION OF THE DRAWINGS

Figure 1:
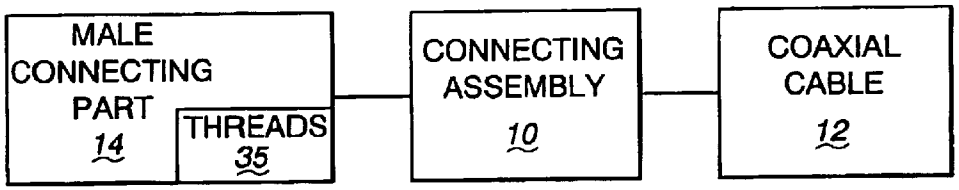
Fig. 1 (Prior Art)
FIG. 1 is a schematic representation of a generic environment for the present invention, consisting of a connecting assembly to join a coaxial cable to an externally threaded connecting part.
Figure 2:
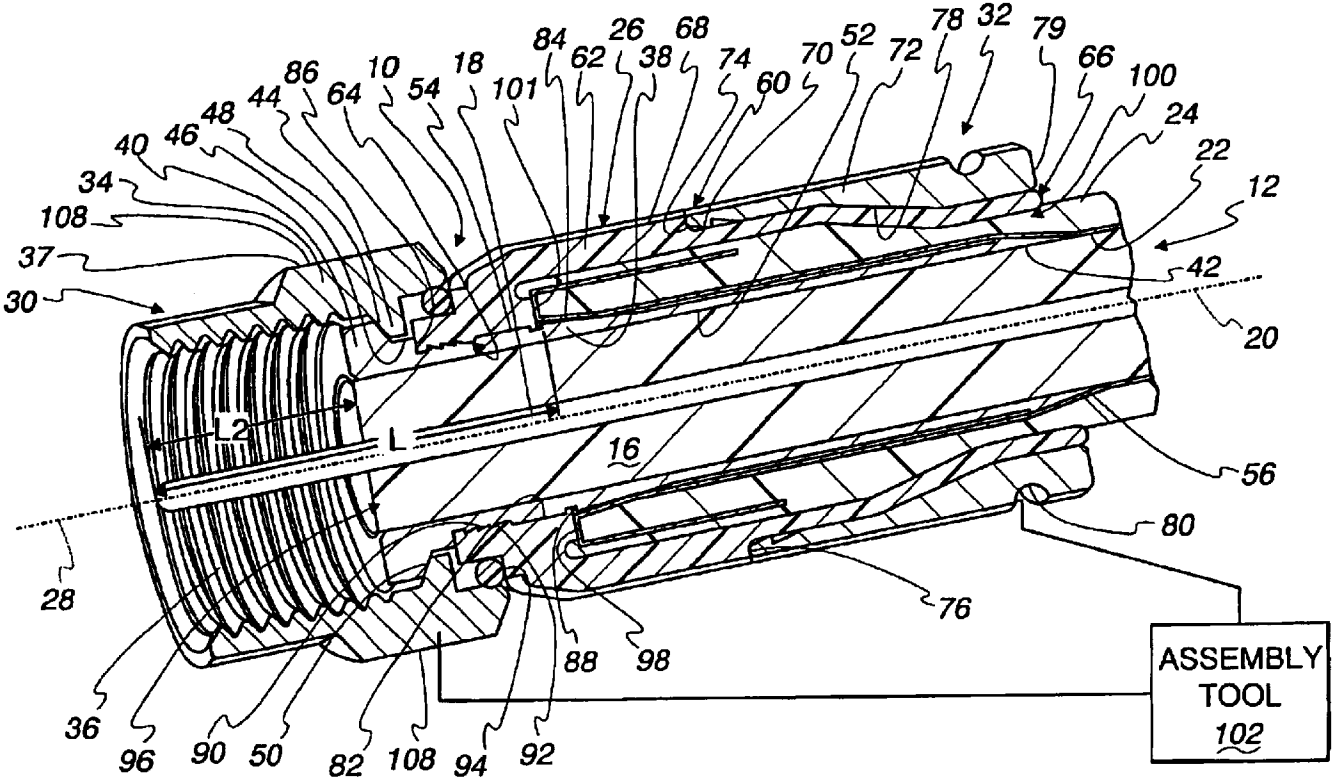
Fig. 2 (Prior Art)
FIG. 2 is a cross-sectional, perspective view of a conventional connecting assembly for joining a coaxial cable to an externally threaded connecting part and with the connecting assembly connected to a coaxial cable.

In FIG. 1, a schematic representation of a generic system environment for the present invention is shown. The system consists of an assembly at 10 for connecting a coaxial cable 12 to an externally threaded connecting part 14. The externally threaded connecting part 14 can be virtually any structure to which coaxial cable is electrically/mechanically connected. For example, the externally threaded connecting part 14 may be a splice component, a drop connection port, a part of a component such as a filter, etc. While the industry generally designates the element 14 a coaxial connector "port", the element 14 will be described herein as a "part" to generically cover a coaxial connector port or any other threaded structure through which a mechanical or a mechanical and electrical connection is made. Similarly, the precise structure for holding the connecting assembly 10 and coaxial cable 12 in operative relationship is not key to the present invention. An exemplary structure for joining the coaxial cable 12 and connecting assembly 10 is shown in FIG. 2. The details of this connecting assembly are shown and described in U.S. Pat. No. 6,153,830, which is incorporated herein by reference. A brief description of that connecting assembly 10 is provided hereinbelow. It should be understood that this connecting assembly 10 is only representative of myriad different connecting assemblies 10 that could be used in similar fashion in conjunction with the inventive concept.

In FIG. 2, a conventional coaxial cable 12 is shown to include an insulating, cylindrical core 16 surrounding an inner conductor 18 which is coaxial with the central axis 20 of the coaxial cable 12. A metallic sheath 22, in the form of braided wire or a foil, surrounds the insulating core 16 and is in turn surrounded by a dielectric, insulating jacket 24.

The connecting assembly 10 consists of a tubular fitting at 26. The tubular fitting 26 has a central axis 28 and axially spaced first and second ends 30,32, respectively. The tubular fitting 26 has a rotatable nut 34 at the first end 30. The rotatable nut 30 has internal threads 36 that are complementary to threads 35 (FIG. 1) on the externally threaded connecting part 14. As a result, the rotatable nut 34 can be joined to the externally threaded connecting part 14 by rotating the nut 34 around the axis 28. The nut 34 has a polygonally-shaped/hexagonal outer surface 37 which can be engaged by a conventional tool/wrench, by radially directing the tool/wrench captively over the outer surface 37.

The second end 32 of the tubular fitting 26 is adapted to receive and hold the coaxial cable 12. More specifically, the tubular fitting 26 has a cylindrical connecting body 38 with a radially enlarged first end 40 and an axially spaced second end 42. The rotatable nut 34 has a wall 44 with an opening 46 therethrough. The opening 46 is dimensioned to allow the connecting body 38 to be advanced from left to right in FIG. 2 therethrough until an annular shoulder 48 at the first connecting body end 40 abuts to an axially oppositely facing annular surface 50 on the wall 44 of the rotatable nut 34.

The connecting body 38 has a through bore 52 of substantially uniform diameter to snugly receive the insulating core 16. The radially outer surface 54 of the connecting body 38 defines a ramp portion 56 at the end 42 of the connecting body 38. As the connecting body 38 is moved axially from left to right in FIG. 2 relative to the coaxial cable 12, the ramp portion 56 wedges between the metallic sheath 22 and insulating core 16 so that the metallic sheath 22 and insulating jacket 24 closely surround and embrace the outer surface 54 of the connecting body 38.

The connecting body 38 is surrounded by a two-part sleeve 60. A first sleeve part 62 is made from a polymer material and has a thickened first axial end 64 and a second axial end 66. The first sleeve part 62 has an outer surface 68 with a radial undercut 70 to receive a second metal sleeve part 72 so that a nose 74 on the second sleeve part 72 abuts to an axially facing shoulder 76 defined in the first sleeve part 62 defined by the undercut 70. The second sleeve part 72 has an inside surface 78 which progressively decreases in diameter from the nose 74 toward the axial sleeve part end 79 remote from the nose 74. The second sleeve part 72 has an annular, undercut groove 80 to accommodate an assembly tool, as hereinafter described.

Figure 3:
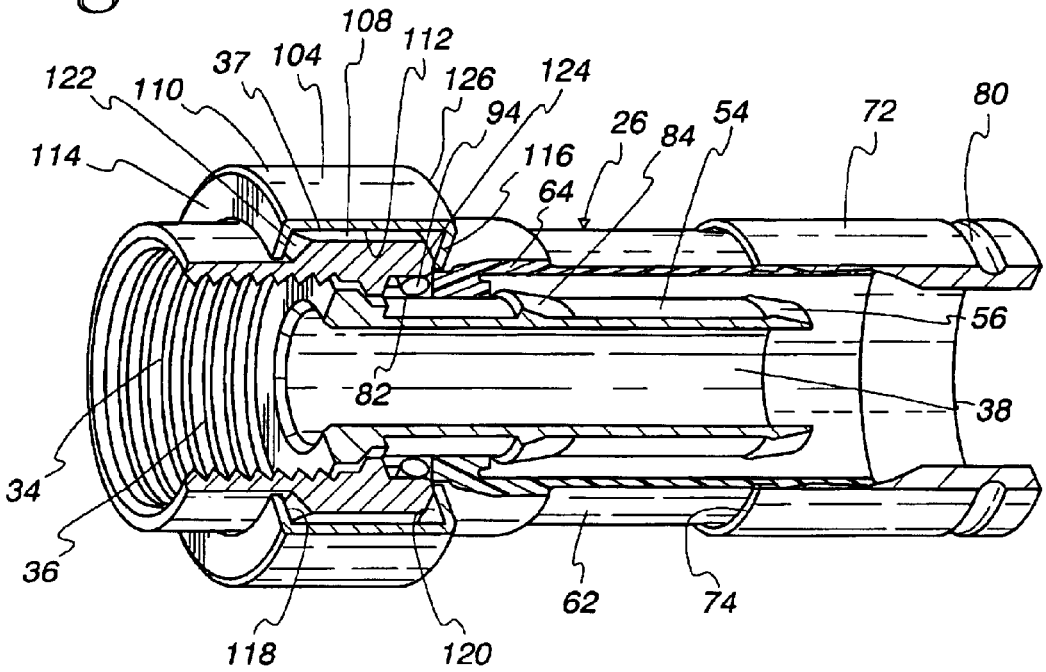
FIG. 3 is a cross-sectional, perspective view of a connecting assembly as in FIG. 2 with a shield assembly, according to the present invention thereon.
Figure 4:
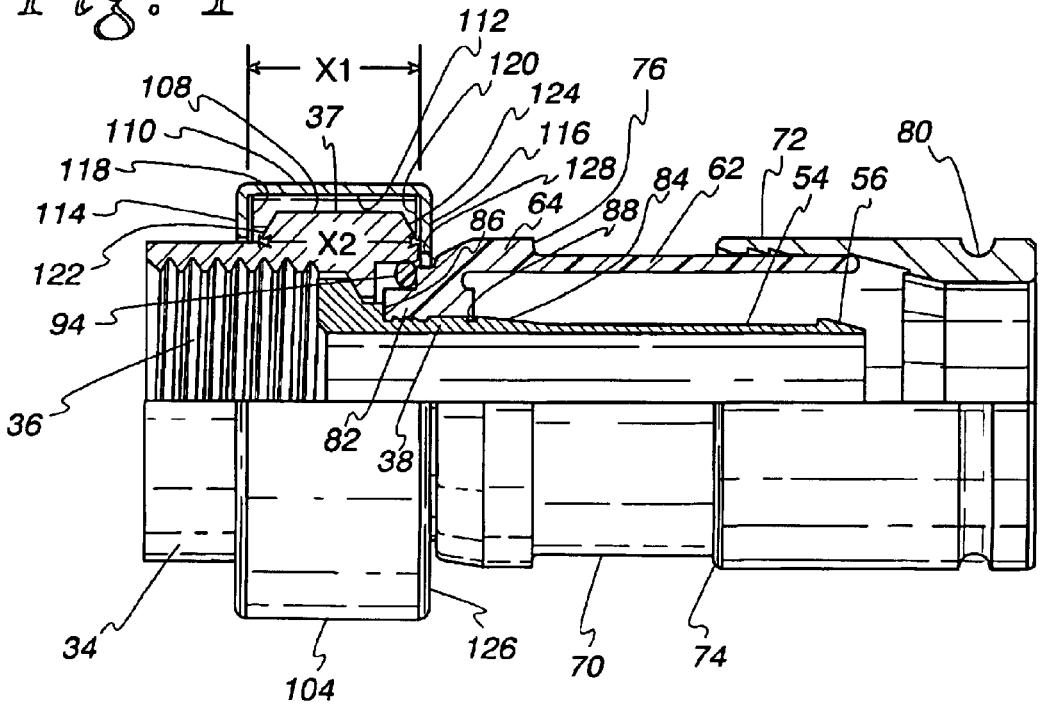
FIG. 4 is a partial cross-sectional, side elevation view of the inventive connecting assembly in FIG. 3.
Figure 5:
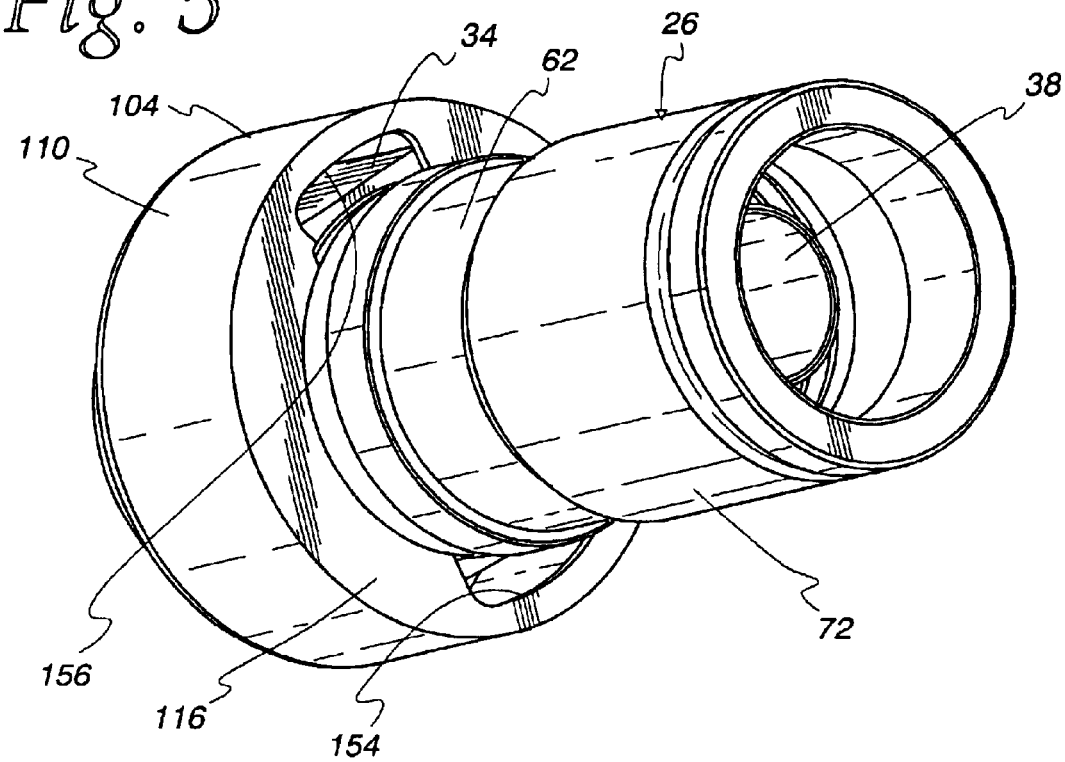
FIG. 5 is a perspective view of the inventive connecting assembly taken from the end opposite that in FIG. 3.

The tubular fitting 26 is prepared for receipt of the coaxial cable 12 by connecting the first sleeve part 72 to the connecting body 38 with the second sleeve part 72 in a pre-assembly position, shown in FIGS. 3 and 4, where the second sleeve part 72 is shifted axially, from left to right in FIGS. 2–4, relative to the first sleeve part 72. With the first sleeve part 62 fully separated from the connecting body 38, right to left movement of the first sleeve part 62 causes the inside surface 82 of the thickened end 64 of the first sleeve part 62 to move axially past the ramp portion 56 axially up to a second ramp portion 84 on the outer surface 54 of the connecting body 38 that increases to a diameter that is greater than the diameter of the inside surface 82 of the sleeve part 62. As a result, the thickened end 64 of the sleeve part 62 must radially deform to allow movement of the sleeve part 62 axially against and past the second ramp portion 84 to a fully assembled state shown in FIGS. 2–4. In the fully assembled state, the thickened end 64 becomes captive between axially facing, annular shoulders 86, 88 on the connecting body 38. Cooperating, annular serrations 90, 92 on the sleeve part 62 and connecting body 38 enhance this connection. A sealing O-ring 94 seals between the sleeve part 62 and the rotatable nut 34.

The coaxial cable 12 is joined to the tubular fitting 26 by first preparing the coaxial cable 12 in a conventional manner. That is, a length L of the insulating jacket 24 is severed at the free end 96 of the coaxial cable 12 so as to expose the metallic sheath 22. At the same time, a length L2 of the insulating core 16 and metallic sheath 22 are removed so as to expose a corresponding length of the inner conductor 18. The exposed metallic sheath 22 is doubled back over the newly formed free end 98 of the insulating jacket 24. The exposed inner conductor 18 and insulating core 16 are then directed into the connecting body bore 52. Upon the end 42 of the connecting body 38 encountering the free end 98 of the insulating jacket 24, the connecting body end 42 wedges between the metallic sheath 22 and the insulating core 16. As the coaxial cable 12 continues to be advanced from right to left in FIGS. 2–4, the insulating jacket 24 with the doubled back metallic sheath 22 moves through an opening 100 between the sleeve part 62 and the connecting body 38. The coaxial cable 12 can be advanced from right to left until the free end 98 of the insulating jacket 24, with the metallic sheath 22 wrapped thereover, abuts to an axially facing, annular shoulder 101 on the sleeve part 62.

The sleeve part 72 is then shifted from the pre-assembly position of FIGS. 3 and 4, axially into the assembled position in FIG. 2 through the use of an assembly tool 102, which acts upon the second sleeve part 72 at the groove 80 and on the rotatable nut 34 to draw the sleeve part 72 axially toward the nut 34. In so doing, the sleeve part 62 is progressively deformed by the sleeve surface 78 radially inwardly from a starting state into a holding state, shown in FIG. 2, wherein the insulating jacket 24 is compressively captured between the sleeve part 72 and the connecting body 38.

According to the invention, as shown in FIGS. 3–8, a shield assembly 104 is attached to the rotatable nut 34 on the tubular fitting 26 so as to limit radial access to the outer surface 37 of the rotatable nut 34 as might allow turning engagement by a conventional tool/wrench. The outer surface 37 of the rotatable nut 34 is defined by a plurality of circumferentially spaced, flat surfaces 108 which cooperatively produce the polygonal/hexagonal shape, previously described. The outer surface 37 is engageable through a conventional wrench which is directed radially relative to the nut 34, so that two facing surfaces on the wrench captively situate against two diametrically opposite, oppositely facing, flat surfaces 108.

In the specific form of the invention shown, the shield assembly 104 consists of a continuous, annular wall 110 with an inside surface 112 having a diameter slightly greater than that of the outer surface 37 of the nut 34. The annular wall 110 extends axially continuously between first and second, radially inwardly extending walls 114, 116, which are axially spaced from each other so as to define, in conjunction with the wall 110, a U shape in cross section.

The walls 114, 116 have axially facing surfaces 118, 120, spaced from each other an axial distance X1. A radially enlarged portion of the rotatable nut 34, with the flat surfaces 108 thereon, has axially oppositely facing surfaces 122, 124. The axial extremities of the surfaces 122, 124 are spaced from each other a distance X2, that is slightly less than the distance X1. Shifting of the shield assembly 104 to the right in FIG. 4 causes the nut surface 122 to abut to the wall surface 118. Similarly, shifting of the shield assembly 104 to the left in FIG. 4, causes the wall surface 120 to abut to the nut surface 124. The cooperation between the surfaces 118, 122; 120, 124 thereby confines movement of the shield assembly 104 In both axial directions relative to the tubular fitting 26. Redundant limiting of the axial movement of the shield assembly 104 to the right in FIG. 4 may be provided by the cooperation between the axially facing outer surface 126 on the wall 116 and an axially oppositely facing surface 128 on the sleeve part 62.

The wall 110 thus blocks axial access to the outer surface 37 of the rotatable nut 34 by a conventional turning tool. According to the invention, a turning tool 140 is employed to rotate the nut 34. More specifically, the turning tool has a body 142 with an extended, U-shaped handle 144 attached thereto. The body 142 has a cylindrical main portion 145 from which spaced legs 146, 148 project in cantilever fashion. Each of the legs 146, 148 has an arcuate cross-sectional shape. The leg 146 has a projection 150 at its free end with a reduced arcuate extent, with the leg 148 having a like projection 152. The projections 150, 152 are arranged to engage diametrically opposite, oppositely facing, flat surfaces 108 on the nut 34.

To accommodate the projections 150, 152, openings 154, 156 are provided in the shield assembly wall 116. The openings 154, 156 accept the projections 150, 152 but will not accept the wider portions 158, 160 of the legs 146, 148, therebehind. As a result, shoulders 162, 164 at the transition between the wider leg portions 158, 160 and the projections 150, 152 abut to the surface 126 to control consistent axial penetration of the projections 150, 152 into the shield assembly 100. By rotating the turning tool 140 around its axis 161 through the handle 144, the rotatable nut 34 can be selectively rotated to either effect tightening or loosening thereof.

Figure 7:
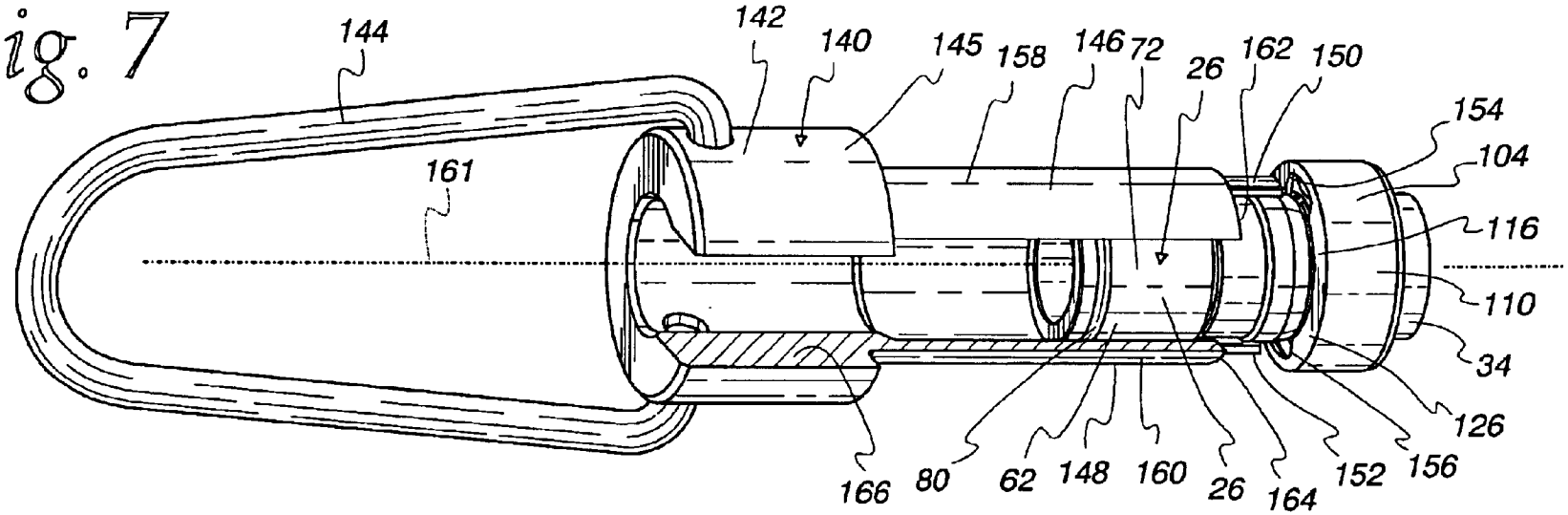
FIG. 7 is a perspective view of the inventive connecting assembly in FIGS. 3–5 with a turning tool, also according to the present invention, in a pre-assembly position relative to the connecting assembly.
Figure 8:
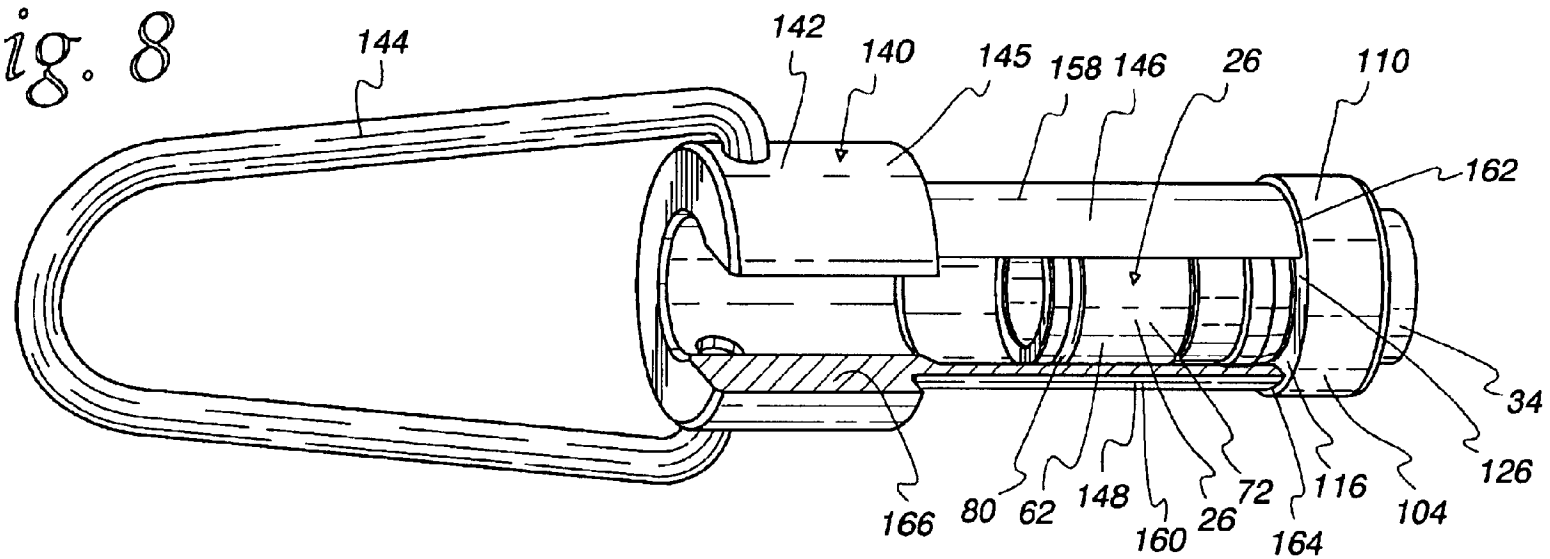
FIG. 8 is a view as In FIG. 7 with the tool directed into an assembled position relative to the connecting assembly.

The main portion 145 of the body 142 has a cutout 166, which allows the turning tool 140 to be placed in the preparatory position of FIG. 7, and the turning position of FIG. 8, with the coaxial cable 12 attached to the tubular fitting 26. The cutout 166 is dimensioned to allow radially passage of the coaxial cable 12 therethrough. Either with or without the coaxial cable 12 connected, the turning tool 140 can be axially aligned with the tubular fitting 26 and repositioned by axial movement to advance the projections 150, 152 through the shield assembly 104 into turning engagement with the rotatable nut 34. The shield assembly 104 is assembled so that it can rotate around the tubular fitting 26. This facilitates alignment of the projections 150, 152 with flat surfaces 108 on the nut 34 and also permits the shield assembly 104 to follow turning movement of the tool 140.

The shield assembly 104 does not extend a substantial distance past the rotatable nut 34 towards the tubular fitting end 32. This affords several advantages. First, the length of the projections 150, 152 can be controlled so that they are not prone to bending under a turning torque applied to the tool 140 and required to either tighten or loosen the nut 34. Additionally, the axial extent of the shield assembly 104 is limited so that the second sleeve part 72 can be shifted axially from the position in FIGS. 3 and 4 to the FIG. 2 position with the shield assembly 104 in place.

Figure 9:
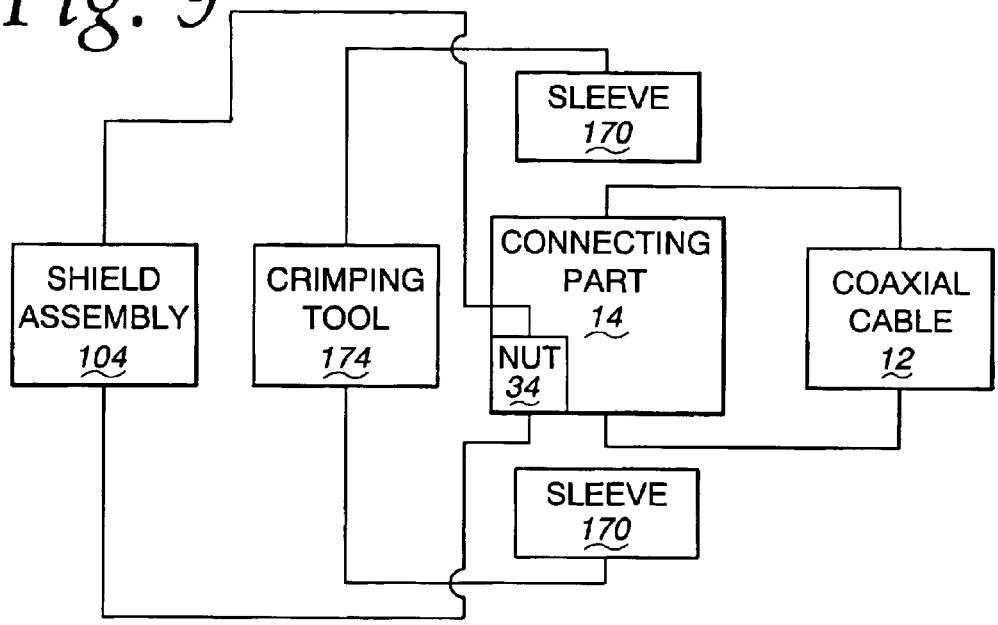
FIG. 9 is a schematic representation of a generic form of connecting assembly, incorporating the inventive shield assembly.

In should again be noted that the use of a translatable sleeve 72 to change a separate sleeve part 62 from a starting state into a holding state to secure the coaxial cable 12 is but exemplary of the many holding/crimping systems contemplated by the present invention. For example, as shown schematically in FIG. 9, any type of sleeve 170 that is part of a tubular fitting can be placed around a connecting part 14 and changed from a starting state into a holding state by radial compression i.e. crimping as through the use of a tool 174.

Regardless of the manner used to secure the coaxial cable 12, with the shield assembly 104 configured as described above and operatively connected, it does not interfere with the cable connecting process through either translation of the sleeve part 72 or crimping of the sleeve 170 through whatever type of tool or mechanism is employed. Accordingly, the tubular fitting 26 can be pre-installed upon the externally threaded connecting part 14 using the tool 140, whereafter the installer can connect the coaxial cable 12 to the secured tubular fitting 26. Thus, a cable installer need not have access to the turning tool 140.

Figure 6:
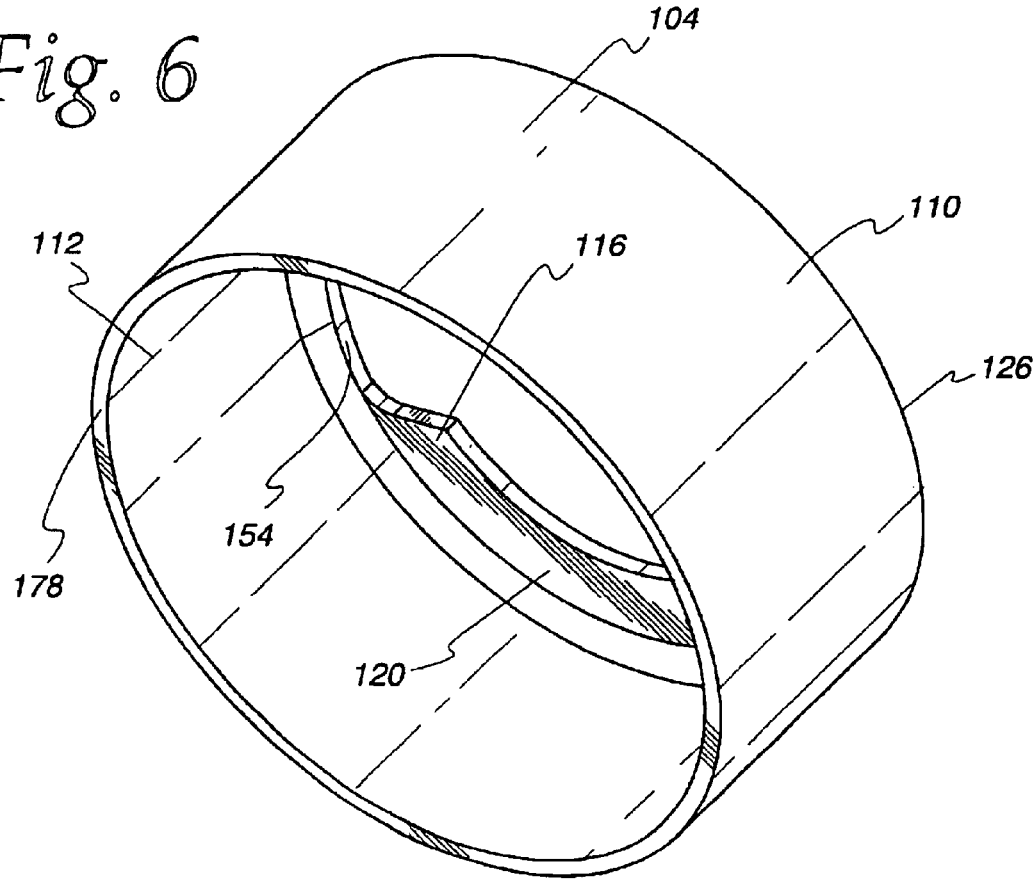
FIG. 6 is a perspective view of a pre-form used to make the inventive shield assembly shown in FIGS. 3–5.

The shield assembly can be fully formed at the point of manufacture or formed in situ. For example, the shield assembly 104 may initially be in a preformed state as shown in FIG. 6 with only the wall 116 preformed. The sleeve assembly preform can then be directed axially over the connecting body 38 and advanced until the wall 116 abuts to the nut surface 124. Thereafter, the wall 114 can be defined by deforming the preform radially inwardly at its axial end 178. On site formation of the wall 114 permits the nut 34 to be tightened using a conventional wrench, whereafter the shield assembly 104 can be reconfigured to its final state.

Figure 10:
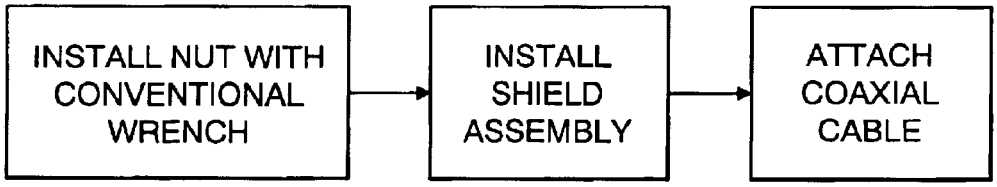
FIG. 10 is a block diagram showing a method of installing a coaxial cable using the inventive shield assembly.

Accordingly, the inventive structure permits different options for installation. For example, as shown in FIG. 10, the rotatable nut can be installed using a conventional wrench upon the externally threaded connecting part 14. Thereafter, the shield assembly 104 preform can be put in place and formed to define the wall 114. Thereafter, the coaxial cable 12 can be attached and the sleeve 60,170 changed from its starting state into its holding state.

Figure 11:
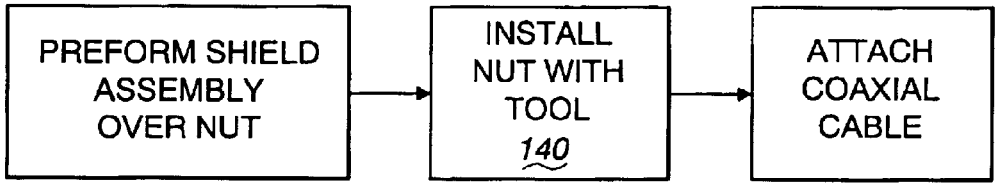
FIG. 11 is a drawing as in FIG. 10 showing an alternative method of installing a coaxial cable using the inventive shield assembly.

As an alternative installation, as shown in FIG. 11, the shield assembly 104 can be preformed at the point of manufacture and the nut 34 connected to the externally threaded connecting part 14 using the turning tool 140. After the rotatable nut 34 is tightened, the coaxial cable 12 can be attached and the sleeve 60,170 changed from its starting state into its holding state.

Figure 12:
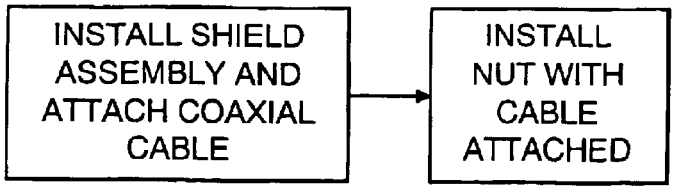
FIG. 12 is a drawing showing a further alternative method of installing a coaxial cable using the inventive shield assembly.

As a still further option, as shown in FIG. 12, the shield assembly 104 can be preformed on the tubular fitting 26 and the coaxial cable 12 secured to the tubular fitting by changing the sleeve 60, 170 from its starting state into its holding state. This preassembled system can then be transported to the site of the externally connecting part 14. The turning tool 140 is then used to tighten the rotatable nut 34 to the externally threaded connecting part 14.

The foregoing disclosure of specific embodiments is intended to be illustrative of the broad concepts comprehended by the invention.

What is claimed is:

1. An assembly for connecting a coaxial cable to an externally threaded connecting part, the connecting assembly comprising:

a tubular fitting having a central axis and axially spaced first and second ends, the tubular fitting comprising a rotatable nut at the first end to threadably engage an externally threaded connecting part, the second end adapted to receive a coaxial cable, the rotatable nut having a contoured surface configured to be operatively engaged by a complementary turning tool having a first configuration that is directed radially into turning engagement with the rotatable nut and usable to turn the rotatable nut around the central axial; and a shield assembly which extends around the rotatable nut and blocks radial access to the contoured outer surface by a turning tool having the first configuration, wherein the shield assembly does not extend substantially beyond the rotatable nut towards the second end of the tubular fitting, the shield assembly configured so that a second tool having a second configuration can be directed axially into turning engagement with the rotatable nut to facilitate turning of the rotatable nut around the central axis.

2. The assembly for connecting a coaxial cable to an externally threaded connecting part according to claim 1 wherein the shield assembly is reconfigured with the shield assembly surrounding the tubular fitting so as to fixedly maintain the shield assembly operatively connected to the tubular fitting.

3. The assembly for connecting a coaxial cable to an externally threaded connecting part according to claim 2 wherein the shield assembly is reconfigured by forming a portion of the shield assembly radially inwardly so as to define a first axially facing surface that abuts to an axially facing surface on the tubular fitting to thereby confine relative axial movement between the shield assembly and tubular fitting.

4. The assembly for connecting a coaxial cable to an externally threaded connecting part according to claim 1 wherein the shield assembly comprises a radially extending wall and the radially extending wall has at least one opening therethrough to receive a second tool having the second configuration which has a portion that can be directed axially through the at least one opening to be operatively engaged with the rotatable nut to facilitate turning of the rotatable nut around the central axis.

5. The assembly for connecting a coaxial cable to an externally threaded connecting part according to claim 4 wherein the rotatable nut has diametrically opposite, oppositely facing first and second flat surfaces and the at least one opening permits spaced elements on a second tool having the second configuration to be directed axially into turning engagement with the first and second flat surfaces.

6. The assembly for connecting a coaxial cable to an externally threaded connecting part according to claim 5 wherein the at least one opening comprises first and second discrete openings.

7. The assembly for connecting a coaxial cable to an externally threaded connecting part according to claim 1 wherein the shield assembly is rotatable guidingly relative to the tubular fitting around the central axis.

8. The assembly for connecting a coaxial cable to an externally threaded connecting part according to claim 1 wherein the second end of the tubular fitting has a connecting body to receive an insulating core on a coaxial cable and the tubular fitting further comprises a surrounding sleeve which is radially deformable from a starting state into a holding state to capture a metallic sheath and an insulating jacket on a coaxial cable between the connecting body and surrounding sleeve, the surrounding sleeve being exposed axially from the shield assembly sufficiently to allow the surrounding sleeve to be changed from the starting state into the holding state.

9. The assembly for connecting a coaxial cable to an externally threaded connecting part according to claim 1 wherein the shield assembly comprises an annular body with radially inwardly extending, axially spaced, first and second walls.

10. The assembly for connecting a coaxial cable to an externally threaded connecting part according to claim 9 wherein the rotatable nut has first and second axially oppositely facing surfaces, the first and second walls on the shield assembly define first and second surfaces facing axially towards each other, the first surface on the first wall is abuttable to the first surface on the rotatable nut to limit movement of the shield assembly in one axial direction relative to the tubular fitting and the second surface on the second wall is abuttable to the second surface on the rotatable nut to limit movement of the shield assembly axially oppositely to the one axial direction relative to the tubular fitting.

11. The assembly for connecting a coaxial cable to an externally threaded connecting part according to claim 1 wherein the contoured surface of the rotatable nut is defined by a plurality of flat surfaces defining a polygonal shape to be engageable by a conventional wrench.

12. The assembly for connecting a coaxial cable to an externally threaded connecting part according to claim 4 in combination with a tool having the second configuration, the tool having the second configuration comprising cantilevered first and second legs which are extendable through the at least one opening through the radially extending wall.

13. The assembly for connecting a coaxial cable to an externally threaded connecting part according to claim 12 wherein the first leg has a shoulder thereon to abut to the radially extending wall to limit axial movement of the first leg through the radially extending wall.

14. An assembly for connecting a coaxial cable to an externally threaded connecting part, the connecting assembly comprising:

a tubular fitting having a central axis and axially spaced first and second ends, the tubular fitting comprising a rotatable nut at the first end to threadably engage an externally threaded connecting part, the second end adapted to receive a coaxial cable; and a shield assembly which extends fully around the rotatable nut, wherein the second end of the tubular fitting has a connecting body to receive an insulating core on a coaxial cable and the tubular fitting further comprises a surrounding sleeve which is radially deformable from a starting state into a holding state to capture a metallic sheath and an insulating jacket on a coaxial cable between the connecting body and surrounding sleeve, the surrounding sleeve being exposed axially from the shield assembly sufficiently to allow the surrounding sleeve to be changed from the starting state into the holding state, wherein a tool can be directed axially into engagement with the rotatable nut to facilitate turning of the rotatable nut, the shield assembly blocking radial access to the rotatable nut by a turning tool.

15. The assembly for connecting a coaxial cable to an externally threaded connecting part according to claim 14 wherein the shield assembly comprises a radially extending wall and the radially extending wall has at least one opening therethrough to receive a second tool having the second configuration which has a portion that can be directed axially through the at least one opening to be operatively engaged with the rotatable nut to facilitate turning of the rotatable nut around the central axis.

16. The assembly for connecting a coaxial cable to an externally threaded connecting part according to claim 14 wherein the rotatable nut has diametrically opposite, oppositely facing first and second flat surfaces to be engaged by a turning tool.

17. The assembly for connecting a coaxial cable to an externally threaded connecting part according to claim 16 in combination with a turning tool having first and second spaced elements which are engageable one each with the first and second flat surfaces.

18. The assembly for connecting a coaxial cable to an externally threaded connecting part according to claim 17 wherein the at least one opening comprises first and second discrete openings to receive the first and second spaced elements.

19. The assembly for connecting a coaxial cable to an eternally threaded connecting part according to claim 14 wherein the shield assembly is reconfigured with the shield assembly surrounding the tubular fitting so as to maintain the shield assembly operatively connected to the tubular fitting.

20. The assembly for connecting a coaxial cable to an externally threaded connecting part according to claim 19 wherein the shield assembly is reconfigured by forming a portion of the shield assembly radially inwardly so as to define a first axially facing surface that abuts to an axially facing surface on the tubular fitting to thereby confine relative axial movement between the shield assembly and tubular fitting.

21. The assembly for connecting a coaxial cable to an externally threaded connecting part according to claim 14 wherein the shield assembly comprises an annular body with radially inwardly extending, axially spaced, first and second walls.

22. The assembly for connecting a coaxial cable to an externally threaded connecting part according to claim 21 wherein the rotatable nut has first and second axially oppositely facing surfaces, the first and second walls on the shield assembly define first and second surfaces facing axially towards each other, the first surface on the first wall is abuttable to the first surface on the rotatable nut to limit movement of the shield assembly in one axial direction relative to the tubular fitting and the second surface on the second wall is abuttable to the second surface on the rotatable nut to limit movement of the shield assembly axially oppositely to the one axial direction relative to the tubular fitting.

23. The assembly for connecting a coaxial cable to an externally threaded connecting part according to claim 17 wherein the first spaced element has a shoulder thereon to abut to the shield assembly to limit axial movement of the first spaced element relative to the shield assembly.

24. An assembly for connecting a coaxial cable to an externally threaded connecting part, the connecting assembly comprising:

a tubular fitting having a central axis and axially spaced first and second ends, the tubular fitting comprising a rotatable nut at the first end to threadably engage an externally threaded connecting part, the second end adapted to receive a coaxial cable; and a shield assembly extending around the rotatable nut, wherein the second end of the tubular fitting has a connecting body to receive an insulating core on a coaxial cable and the tubular fitting further comprises a surrounding sleeve which is radially deformable from a starting state into a holding state to capture a metallic sheath and an insulating jacket on a coaxial cable between the connecting body and surrounding sleeve, the surrounding sleeve being exposed axially from the shield assembly sufficiently to allow the surrounding sleeve to be changed from the starting state into the holding state.

25. An assembly for connecting a coaxial cable to an externally threaded connecting part, the connecting assembly comprising:

a tubular fitting having a central axis and axially spaced first and second ends, the tubular fitting comprising a rotatable nut at the first end to threadably engage an externally threaded connecting part, the second end adapted to receive a coaxial cable; and a shield assembly extending around the rotatable nut, wherein the second end of the tubular fitting has a connecting body to receive an insulating core on a coaxial cable and the tubular fitting further comprises a surrounding sleeve which is radially deformable from a starting state into a holding state to capture a metallic sheath and an insulating jacket on a coaxial cable between the connecting body and surrounding sleeve, the surrounding sleeve being exposed axially from the shield assembly sufficiently to allow the surrounding sleeve to be changed from the starting state into the holding state, wherein the shield assembly comprises a first radially extending wall and a second radially extending wall, the first and second radially extending walls defining axially facing first and second surfaces between which a part of the tubular fitting resides so that the shield assembly is limited in movement in axially opposite directions relative to the tubular fitting.

26. The assembly for connecting a coaxial cable to an externally threaded connecting part according to claim 25 wherein the rotatable nut defines the part of the tubular fitting.

27. An assembly for connecting a coaxial cable to an externally threaded connecting part, the connecting assembly comprising:

a tubular fitting having a central axis and axially spaced first and second ends, the tubular fitting comprising a rotatable nut at the first end to threadably engage an externally threaded connecting part, the second end adapted to receive a coaxial cable, means on the tubular fitting that can be reconfigured to grippingly hold an end of a coaxial cable; and shield means operatively connected to the tubular fitting for permitting access to the rotatable nut by a turning tool directed axially up to the rotatable nut and for blocking access to the rotatable nut by a turning tool directed radially toward the rotatable nut, the shield means configured so that the means on the tubular fitting can be reconfigured to grippingly hold an end of a coaxial cable with the shield means operatively connected to the tubular fitting.

28. A method of connecting a coaxial cable to an externally threaded connecting part through a tubular fitting having a central axis and axially spaced first and second ends and a rotatable nut at the first end, the method comprising the steps of:

threadably connecting the rotatable nut to the externally threaded connecting part;

attaching a shield assembly to the tubular fitting so that the shield assembly blocks radial access to the rotatable nut;

directing the coaxial cable into the second end of the tubular fitting; and with the coaxial cable in the second end of the tubular fitting and the shield assembly attached to the tubular fitting, reconfiguring the tubular fitting to grippingly hold the coaxial cable and tubular fitting together.

29. The method of connecting a coaxial cable to an externally threaded connecting part according to claim 28 wherein the shield assembly is attached to the tubular fitting before the rotatable nut is threadably connected to the externally threaded connecting part.

30. The method of connecting a coaxial cable to an externally threaded connecting part according to claim 29 wherein the step of attaching a shield assembly comprises deforming a part of the shield assembly with the shield assembly surrounding the tubular fitting.

31. The method of connecting a coaxial cable to an externally threaded connecting part according to claim 29 wherein the step of threadably connecting the rotatable nut comprises directing a turning tool axially relative to the tubular fitting into engagement with the rotatable nut radially between the shield assembly and rotatable nut.

32. The method of connecting a coaxial cable to an externally threaded connecting part according to claim 31 wherein the step of directing a turning tool comprises directing first and second legs on the turning tool axially relative to the tubular fitting so that the first and second legs captively engage first and second oppositely facing flat surfaces on the rotatable nut.

33. The method of connecting a coaxial cable to an externally threaded connecting part according to claim 31 wherein the step of directing a turning tool comprises directing first and second legs on the turning tool through first and second discrete openings through the shield assembly.

34. The method of connecting a coaxial cable to an externally threaded connecting part according to claim 10 wherein the first surface on the nut is adjacent to the first surface on the first wall and the second surface on the nut is adjacent to the second surface on the second wall so that relative axial movement between the slider assembly and rotatable nut is substantially confined.

* * * * *